United States Patent [19]

Schäfer

[11] Patent Number: 4,947,992

[45] Date of Patent: Aug. 14, 1990

[54] STORAGE AND/OR TRANSPORTATION CASE

[75] Inventor: Gerhard Schäfer, Neunkirchen, Fed. Rep. of Germany

[73] Assignee: Fritz Schäfer Gesellschaft Mit Beschränkter Haftung, Neunkirchen, Fed. Rep. of Germany

[21] Appl. No.: 327,336

[22] Filed: Mar. 22, 1989

[30] Foreign Application Priority Data

Mar. 23, 1988 [DE] Fed. Rep. of Germany ... 8803932[U]

[51] Int. Cl.[5] ..... B65D 21/04

[52] U.S. Cl. ..... 206/506

[58] Field of Search ..... 206/501, 506

[56] References Cited

U.S. PATENT DOCUMENTS

| | | | |
|---|---|---|---|
| 2,489,470 | 11/1949 | Ullrich | 206/506 |
| 3,951,265 | 4/1976 | Carroll | 206/506 |
| 4,105,117 | 8/1978 | Atkin | 206/501 |

FOREIGN PATENT DOCUMENTS

| | | | |
|---|---|---|---|
| 2344423 | 3/1975 | Fed. Rep. of Germany . | |
| 2728735 | 1/1979 | Fed. Rep. of Germany | 206/501 |
| 1450763 | 7/1966 | France | 206/506 |
| 2124771 | 9/1972 | France . | |
| 7606604 | 12/1977 | Netherlands | 206/506 |
| 2129401 | 5/1984 | United Kingdom | 206/506 |

*Primary Examiner*—George E. Lowrance

*Attorney, Agent, or Firm*—Toren, McGeady & Associates

[57] ABSTRACT

The innovation is directed to a storage and/or transportation case comprising longitudinal and transverse walls which incline inward from the top opening to the base, as well as two U-shaped handle stirrups which are supported at opposite sides of the case in horizontal swivel bearings which are provided at the upper edge of the case so as to be flush with one another, which handle stirrups can be folded down against the outside of the walls, so that a plurality of empty cases may be placed one inside the other, and can be swiveled inward and placed on the upper edge of the case, so that cases may be placed one on top of the other for the purpose of forming stack-type supports, and which fix a case, which is placed on, in one direction (e.g. the longitudinal direction) with stirrup parts which are bent horizontally toward the middle of the case and fix the case in the other direction (e.g. in the transverse direction) with stirrup parts which are bent down vertically at a right angle to the stirrup handle.

11 Claims, 5 Drawing Sheets

STORAGE AND/OR TRANSPORTATION CASE

The innovation is directed to a storage and/or transportation case comprising longitudinal and transverse walls which incline inward from the top opening to the base, as well as two U-shaped handle stirrups which are supported at opposite sides of the case in horizontal swivel bearings which are provided at the upper edge of the case so as to be flush with one another, which handle stirrups can be folded down against the outside of the walls, so that a plurality of empty cases may be placed one inside the other, and can be swiveled inward and placed on the upper edge of the case, so that cases may be placed one on top of the other for the purpose of forming stack-type supports, and which fix a case, which is placed on, in one direction (e.g. the longitudinal direction) with stirrup parts which are bent horizontally toward the middle of the case and fix the case in the other direction (e.g. in the transverse direction) with stirrup parts which are bent down vertically at a right angle to the stirrup handle.

Such cases are already known from the DE-OS No. 36 14 920. These cases comprise stirrups which can be placed on the upper edge of the case, the handles of the stirrups forming the supporting surface for another case to be placed on top. This case is secured against slippage in one direction by means of a bent portion of the handle stirrup. The case is fixed in the other direction by means of end prolongations which are bent horizontally toward the middle of the case and are arranged between the two swivel bearings. However, these known cases have the disadvantage that wire interfaces are exposed at the end of the end prolongations which are bent toward the middle of the case, which wire interfaces can result in damage to the case placed on top on the one hand and to injuries when lifting the case on the other hand. Moreover, it has proven disadvantageous that the end prolongations which are bent toward the middle of the case limit the gripping space, especially since the end prolongations must be long enough to ensure a secure fixing of the case which is placed on top. It has also been shown that the stirrups can easily spring out of the swiveling stirrup bearings when lifting the case.

Therefore, the object of the innovation is to provide a storage and/or transportation case of the generic type which enables the freest and most reliable possible access to the middle part of the stirrup used as handle without the accurate fixing of a case which is placed on top being impaired by the horizontal stirrup parts.

In order to meet this object the storage and/or transportation case is characterized in that the handle stirrups are arranged with their end portions in swivel bearings, and in that each of the stirrup parts, which are bent horizontally toward the middle of the case for fixing the case in one direction when the latter is placed on top, is arranged between a swivel bearing and a stirrup portion which can be placed on the upper edge of the case.

In this way it is possible to secure a transportation case of the same size as a transportation case upon which it is placed against slippage without the wire interfaces coming into contact with the case which is placed on top. Since the interfaces are located inside the swivel bearings, no corrosion occurs. Another advantage consists in that the middle portion of the stirrup handle used in lifting is not cramped, since the horizontal stirrup parts are arranged in proximity to the corners of the case.

Various arrangement possibilities have proven advisable. According to claim 2, it is provided that the two end portions of a handle stirrup be inserted into the swivel bearings from the swivel bearing opening located on the outside.

However, it is also possible—according to claim 3—for the two end portions of a handle stirrup to be inserted into the swivel bearings from the inner oppositely located swivel bearing openings.

Finally, according to claim 4, one end portion of a handle stirrup can also be inserted into the swivel bearing from the outer swivel bearing opening and the other end portion can be inserted into the swivel bearing from the inner swivel bearing opening.

The swivel bearings are constructed in a block-shaped or cube-shaped manner, according to claim 5, and comprise at least one undercut guide at the foot side which can be slid into correspondingly shaped undercut guides from the outside of the case up to a stop, the latter guides being fixed with respect to the case. In this way, the swivel bearings are securely connected with the case. Also, when the filling weight of the cases is large, the occurring tensile forces when lifting the case are transmitted from the stirrup via its swivel bearing to the guides which are fixed with respect to the case.

According to claims 6 and 7, the block-shaped or cube-shaped swivel bearings are held in their end position by means of catch devices which can be locked and unlocked and which consist of a tab which can catch in a slot provided in the area of the guides which are fixed with respect to the case. Accordingly, the block- or cube-shaped bearings can not only be connected with the case in a simple and secure manner but can also be detached easily when desired. It is only necessary to actuate the catch device.

The handle stirrups can be arranged so as to be swivelable at the upper edge of either the transverse walls or the longitudinal walls. If they are supported at the upper edge of the longitudinal walls, two small cases having approximately half the area of the supporting large case can be placed on top when the handle stirrups are swiveled inward. The smaller cases are then placed on top at a right angle to the longitudinal axis of the large supporting case. In this instance, the handle stirrups advantageously comprise a bent portion in the middle, according to claim 8, which is directed upward when the stirrups are bent inward and secures the smaller cases against displacement in their transverse direction.

Instead of the two small cases, another large case can also be placed on the supporting large case if this large case comprises a recessed portion in the middle of its lower longitudinal edge, which recessed portion is larger with respect to its dimensioning than the bent portion of the stirrups (claim 9).

Finally, it is also possible to place a large case on two adjacent small cases whose longitudinal axes extend parallel to one another for the purpose of stacking if, according to claim 10, the longitudinal walls of the small cases are lowered relative to the transverse walls to the height of the handle stirrups which are swiveled inward.

According to claim 11, a tool for plastics injection molding of the storage and/or transportation case is advisably constructed in such a way that exchangeable angular insert pieces are provided at one tool half for the production of the undercut guides, which are fixed with respect to the case and serve to fasten the swivel bearings; the insert pieces comprise shaped parts at only one of their two legs, which shaped parts serve to form the guides at the upper edges of either the transverse or longitudinal walls of the case.

The subject matter of the innovation is shown in the drawing in embodiment examples.

Figure 1:
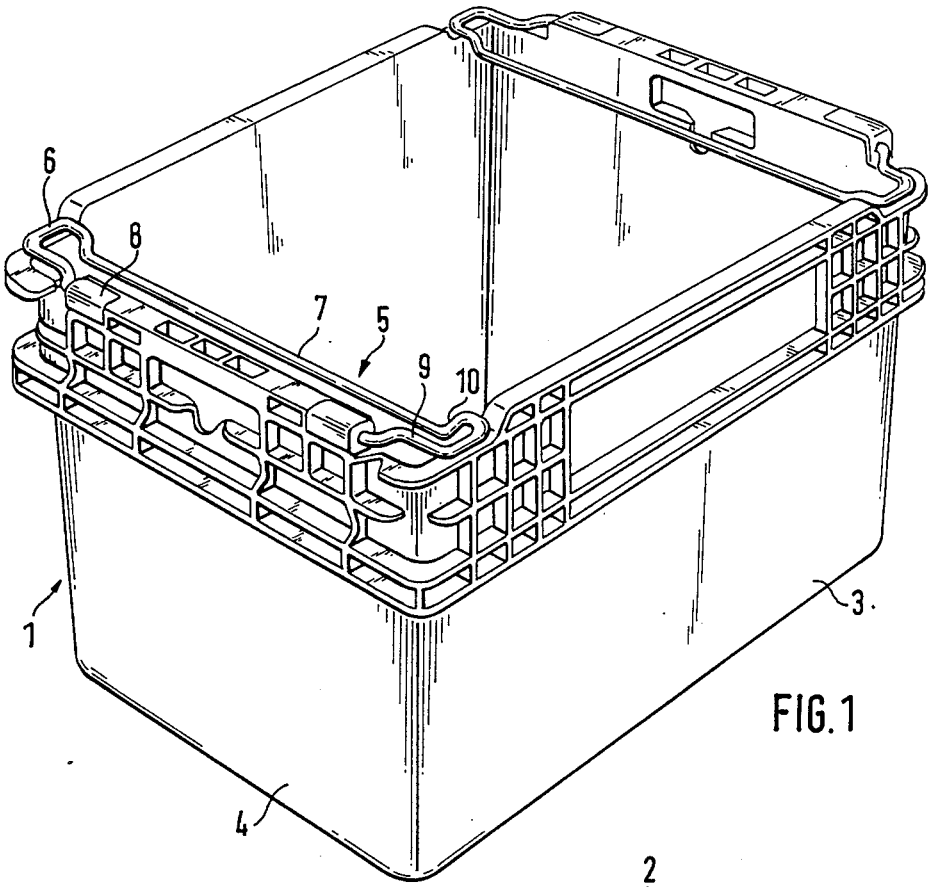
FIG. 1 shows a transportation case in a three-dimensional view and as seen diagonally from above.

If an additional transportation case 101 is placed on top of the storage and/or transportation case 1 shown in FIG. 1, which additional transportation case 101 is the same size as the latter, the handle stirrups 5 which are supported at the upper edges of the transverse walls 4 in swivel bearings 8 are swiveled inward in order to form stack supports.

Figure 2:
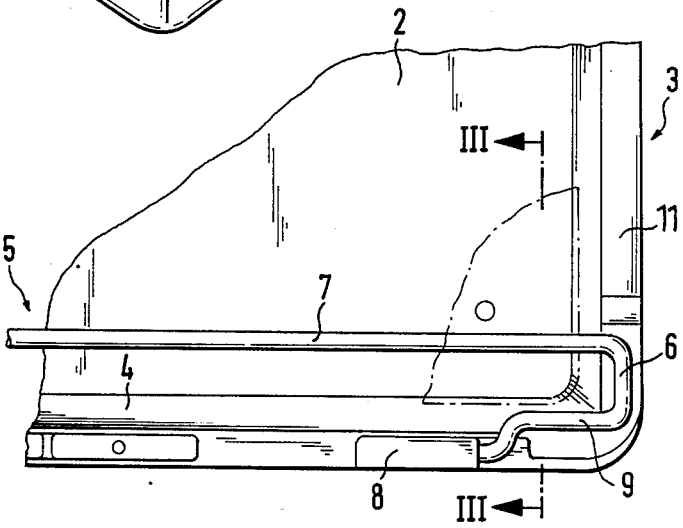
FIG. 2 shows a top view of a corner area of the transportation case with stirrups which are swiveled inward and lie on top.

The handle stirrups 5 rest on the upper edge 11 of the case with two stirrup portions 6 (FIGS. 1 and 2). In so doing, the handle stirrups 5 form the stack support for an additional case which rests on the middle part 7 of the stirrup with its base 2. In order to fix the case, which is placed on top, in position, a stirrup part 9 which is bent horizontally toward the middle of the case is provided between the swivel bearing 8 and the stirrup portion 6 which can be placed on top, which stirrup part 9 contacts the outside of a case which is placed on top and secures it against slippage. Bent portions 10, which fix a case which is placed on top in the other direction by means of its vertical stirrup parts, which are bent down at a right angle relative to the stirrup portion 6 which can be placed on top, are provided at the two sides of the handle stirrup 5.

Figure 3:
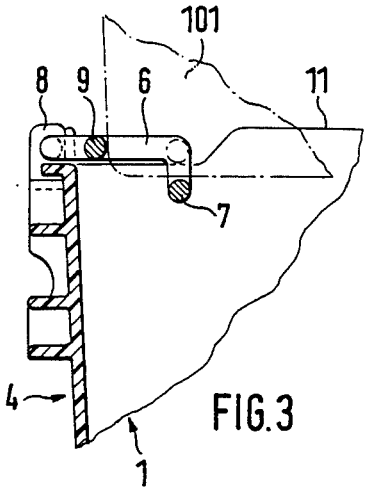
FIG. 3 shows a section along line III—III in FIG. 2.

FIG. 3 illustrates how a case 101 which is placed on top is fixed in position by means of the middle part 7 of the stirrup of the case located under it and by means of the horizontal stirrup part 9. Recessed portions for receiving the middle parts 7 of the stirrup when they are swiveled outward against the outside of the transverse walls from the position shown in FIG. 3 are provided below the swivel bearings 8 at the outside of the transverse walls 4 (FIG. 4).

The various possibilities of swivel bearing and handle stirrup fastening are shown in FIGS. 5 to 12.

Figure 5:
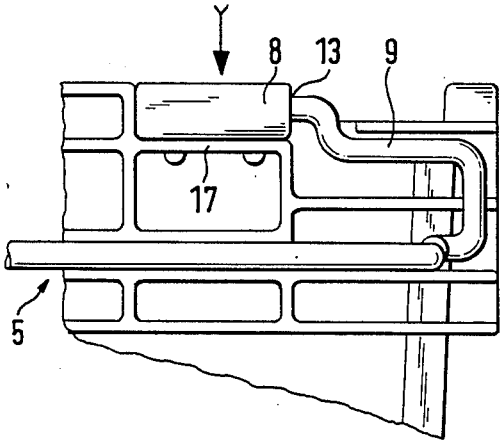
FIG. 5 shows a view in the direction of arrow V in FIG. 4 with a first fastening possibility of a swivel bearing.
Figure 6:
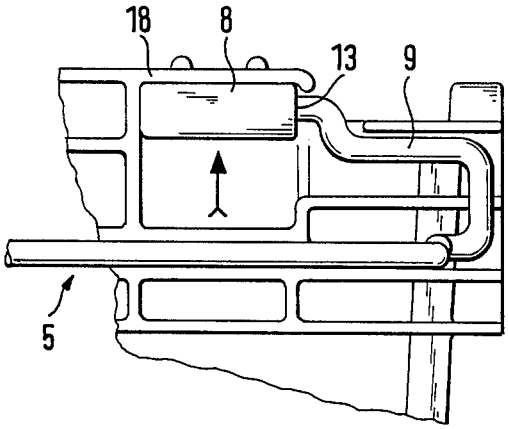
FIG. 6 shows a view in the direction of arrow V in FIG. 4 with a second fastening possibility of a swivel bearing.

FIG. 5 shows a type of fastening for the block- or cube-shaped swivel bearing 8 at the upper edge of the case. The swivel bearing 8 is screwed together with the transverse wall rib 17.

Figure 4:
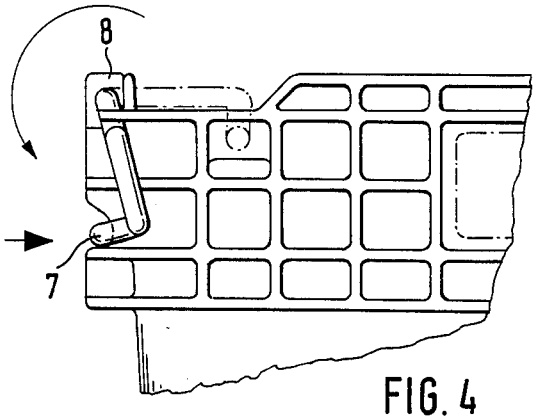
FIG. 4 shows a view of the edge area of a transportation case with folded down stirrup.

In the embodiment form according to FIG. 4, the block- or cube-shaped swivel bearing 8 fits under the transverse wall rib 18 which extends in the plane of the upper edge 11 of the case.

Figure 7:
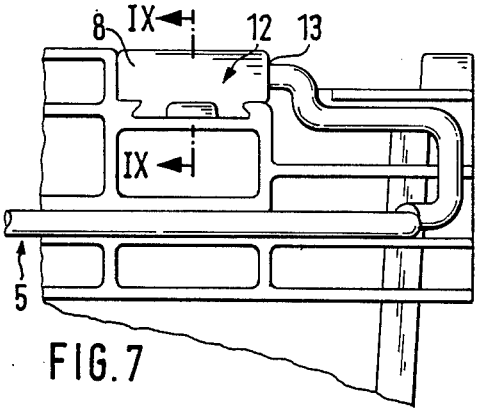
FIG. 7 shows a view in the direction of arrow V in FIG. 4 with a third fastening possibility of a swivel bearing.
Figure 8:
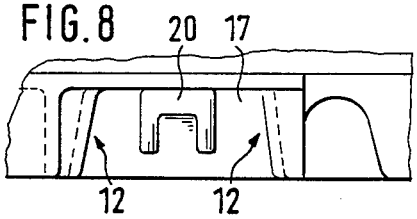
FIG. 8 shows a top view of an edge area of the case in which the fastening possibility, shown in FIG. 7, which is fixed with respect to the case, is provided for a swivel bearing which has been removed and is therefore not shown.
Figure 9:
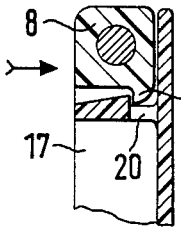
FIG. 9 shows a section along line IX—IX of FIG. 7.

Another embodiment form is shown in FIGS. 7 to 9. In this instance, the swivel bearings 8 are provided with dovetail connections 12 and can accordingly be slid on from the outside of the case in the direction of the arrow in FIG. 9. The swivel bearings 8 are fixed in their position after being completely slid on by means of a catch device which consists of a tab 19 attached to the swivel bearing 8 and a slot 20 which is cut into the transverse wall rib 17. When the swivel bearing has reached its position, the tab 19 catches in the slot 20. In order to disengage the catch connection, the tab 19 is pressed upward slightly so that the block- or cube-like swivel bearing 8 can be slid out of the guide of the dovetail connection 12, which guide is fixed with respect to the case. This type of fastening makes it possible to exchange damaged stirrups in a simple manner. Instead of the dovetail-shaped guides, other shapes with recesses can also be used, e.g. T-shaped guides which are fixed with respect to the case and engage in correspondingly constructed undercut recesses at the foot of the swivel bearing.

Figure 11:
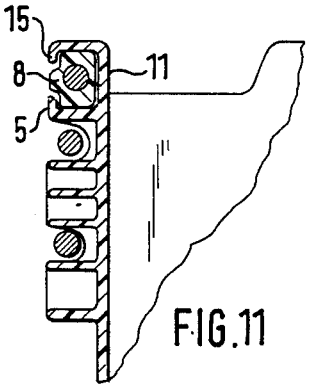
FIG. 11 shows a section along line XI—XI in FIG. 10.
Figure 10:
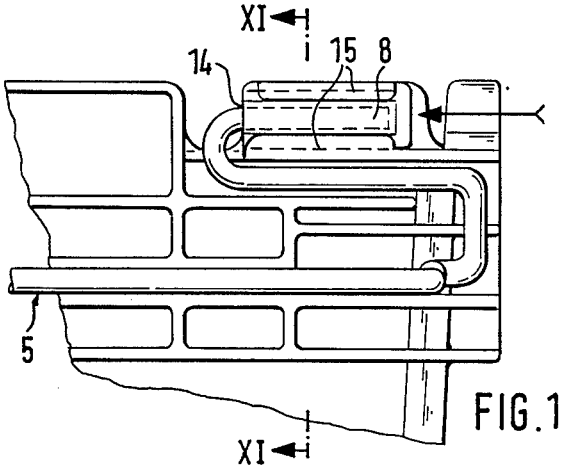
FIG. 10 shows another embodiment form of a stirrup.

In the previously shown embodiment forms, the handle stirrups 5 are inserted into the swivel bearings 8 from the outer swivel bearing openings 13. However, as is shown in FIGS. 10 and 11, there is also the possibility of inserting the handle stirrups 5 into the inner, oppositely located swivel bearing openings 14 of the swivel bearings 8 and fixing them there e.g. by means of a bearing stopper. This has the advantage that the swivel bearings 8 can be situated closer to the corners of the case. Accordingly, the free space in the handle area is larger and the horizontal stirrup parts 9 can fix a case which is placed upon it more accurately and securely by means of a longer contacting surface. The swivel bearings 8 are enclosed and held by the lateral flange 15 of the upper edge 11 of the case (FIG. 11).

Figure 12:
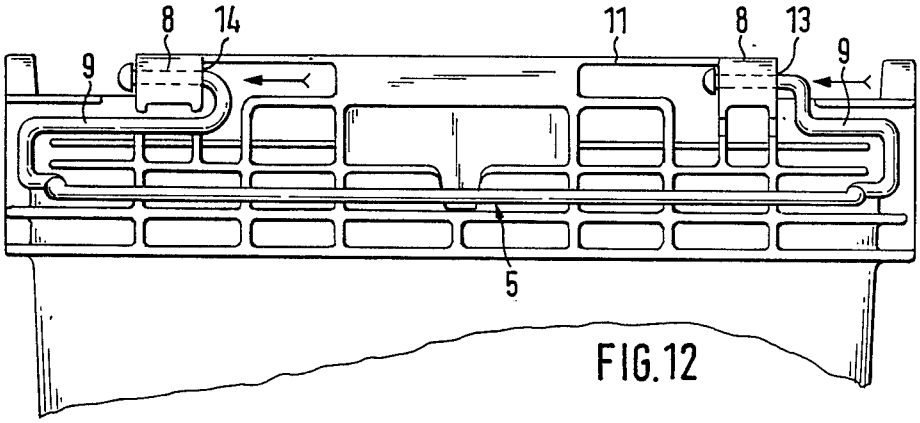
FIG. 12 shows a side view of the edge area of the transportation case in another embodiment form of a stirrup.

FIG. 12 shows a combination of the swivel bearing and handle stirrup arrangement according to FIGS. 1 and 10. A swivel bearing 8 which is formed on at the upper edge 11 of the case is provided in this instance on the right-hand side, the handle stirrup 5 being slid in through the outer swivel bearing opening 13, while the stirrup is inserted on the left-hand side through the inner swivel bearing opening 14. The two stirrup ends can be slid into the swivel bearings 8 simultaneously and in a simple manner from one side by means of this combination without the necessity of pressing apart the stirrup ends so as to allow a springing into the bearing.

Figure 13:
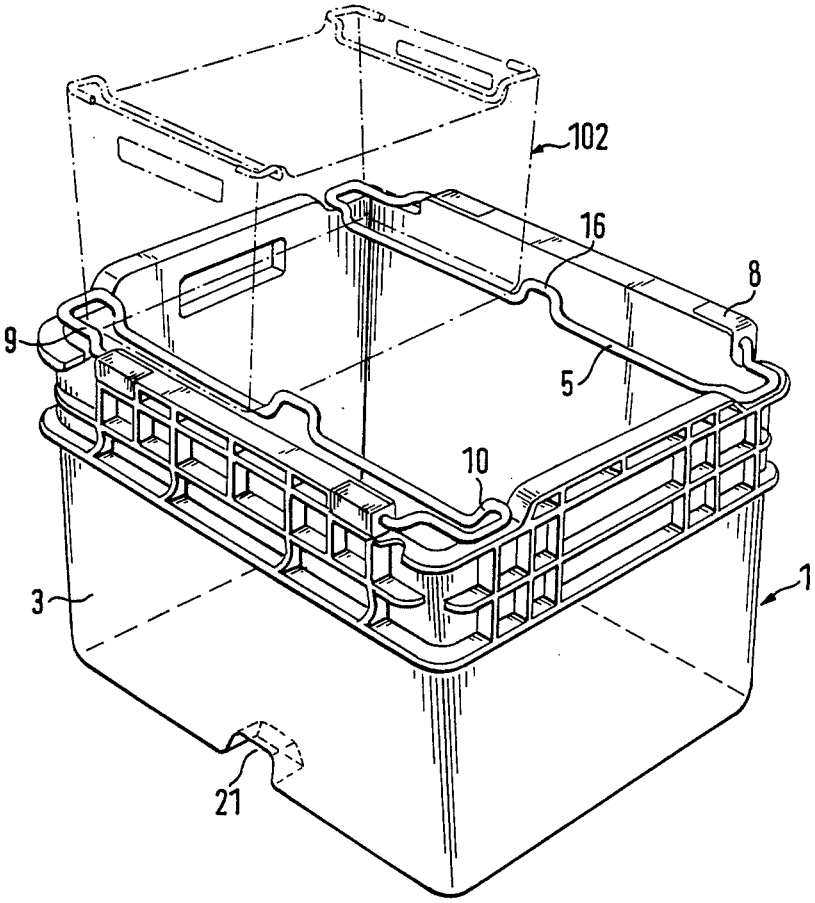
FIG. 13 shows another transportation case in a three-dimensional view as seen diagonally from above.
Figure 14:
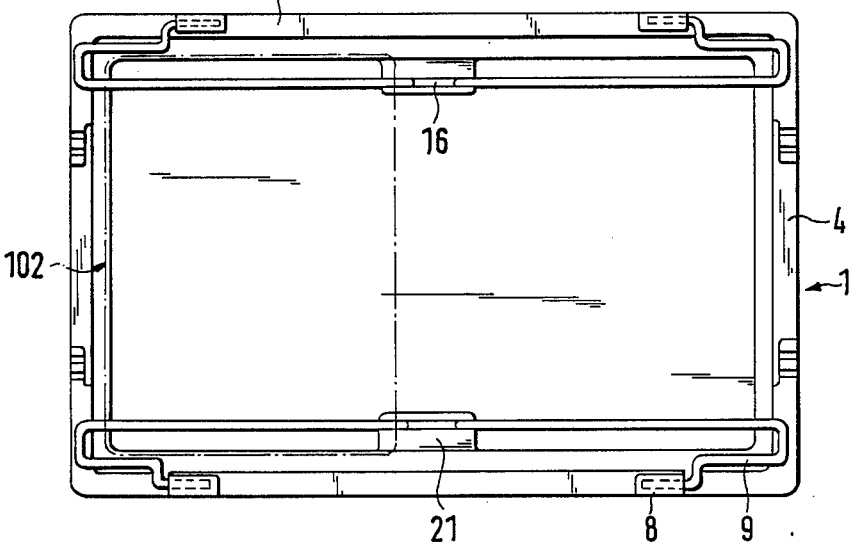
FIG. 14 shows a top view of the transportation case according to FIG. 13.

In the storage and/or transportation case 1 shown in FIG. 13, the handle stirrups 5 are arranged at the upper edge of the longitudinal walls 3 of the case so as to be swivelable, specifically in the same manner as the swivel stirrups at the upper edge of the transverse walls 4 of the case, which are shown in FIG. 1.

The handle stirrups 5 are provided with a bent portion 16 in the middle. Two small cases 102 can be placed next to one another on the storage and/or transportation case 1 shown in FIG. 13, as is indicated. The cases 102 are secured in their position by means of the horizontal stirrup parts 9, the vertically extending bent portions 10 and the bent portions 16 in the middle of the stirrup.

The case according to FIG. 13 also allows a case of the same size to be placed on top, provided that a recessed portion 21 which is dimensioned so as to be slightly larger than the bent portion 16 is formed in the middle of the lower longitudinal edge.

Finally, there is also the possibility of placing a large case 1 in two small cases 102 arranged next to one another. For this purpose, the longitudinal walls of the small case must be lowered relative to their transverse walls to the height of the inwardly swiveled handle stirrups.

Figure 15:
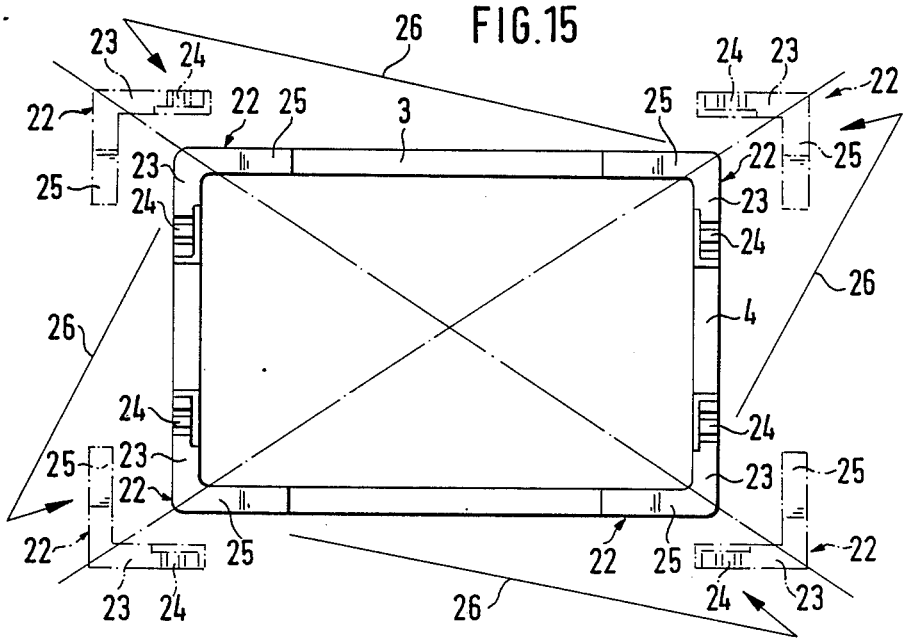
FIG. 15 shows a schematic view of portions of the injection molding tool.

FIG. 15 shows that the tool for the injection molding of the storage and/or transportation cases, which are manufactured from plastics material, can be re-equipped by means of a simple step. A total of four exchangeable angular insert pieces 22 are provided at one tool half, which insert pieces 22 comprise shaped parts 24 for the shaping of the guide, which is fixed with respect to the case (FIG. 7), at the upper edges of the transverse (FIG. 1) or longitudinal walls (FIG. 13) at only one of their two legs, specifically at the leg 23. The other leg 25 is constructed in a neutral manner.

Guides which are fixed with respect to the case can be formed at the upper edges of the transverse walls with the construction of the angular insert pieces 22 shown by means of solid lines in FIG. 15. If the insert pieces 22 are removed, shifted to the next corner of the tool half in the manner shown by the arrow 26 (indicated by dashed lines) and inserted there instead of the respective removed insert piece 22, the guides, which are fixed with respect to the case, can be constructed at the longitudinal walls 3.

I claim:

1. Storage and/or transportation case, comprising:

longitudinal and transverse walls inclined inwardly from an upper opening to a base of the case; and two U-shaped handle stirrups having end segments, the stirrups being supported by the end segments at opposite sides of the case in horizontal mutually aligned swivel bearings which are provided at the upper edge of the case, the handle stirrups being foldable downwardly against an outer side of the walls so that a plurality of empty cases are placeable one inside the other, the stirrups also being pivotable inwardly and placeable on the upper edge of the case so as to form stacking supports so that cases may be stacked one on top of the other, the stirrups having horizontal parts bent towards the case center so as to fix a stacked case in one direction, and further parts are bent down vertically at a right angle to the stirrup handle so as to fix the stacked cases in a direction transverse to the one direction, each of the horizontal stirrup parts (9) being arranged between a swivel bearing (8) and a portion (6) of the stirrup which can be placed on top on the upper edge (11) of the case, and spaced from a middle portion (7) of the stirrup which forms a support for the stacked case.

2. Storage and/or transportation case according to claim 1, wherein the end portions of a handle stirrup (5) are inserted into the swivel bearings (8) from an outwardly opening swivel bearing opening (13).

3. Storage and/or transportation case according to claim 1, wherein the end portions of a handle stirrup (5) are inserted into the swivel bearings (8) from swivel bearing openings (14) which are located opposite one another on the inside.

4. Storage and/or transportation case according to claim 1, wherein one end portion of a handle stirrup (5) is inserted into the swivel bearing from an outwardly opening swivel bearing opening (13), and the other end portion is inserted into the swivel bearing from an inwardly opening swivel bearing opening (14).

5. Storage and/or transportation case according to claim 1, wherein the swivel bearings (8) are constructed so as to be one of block-shaped and cube-shaped and comprise at least one undercut guide at a foot side which is slidable into correspondingly shaped undercut guides from the outside of the case up to a stop, which guides are fixed with respect to the case.

6. Storage and/or transportation case according to claim 5, and further comprising a catch device which can detachably lock the swivel bearings (8) in their end position.

7. Storage and/or transportation case according to claim 6, wherein the catch device comprises a tab (19) which can catch in a slot (20) provided in an area of the guide which is fixed with respect to the case.

8. Storage and/or transportation case according to wherein the handle stirrups are supported at the upper edge of the longitudinal walls and serve to support small cases which are placed on at a right angle to the longitudinal axis of the case and have approximately half the area of a large case to be supported, the handle stirrups (5) include a bent portion (16) in their middle which is directed upward when the stirrups are swiveled inward and secures the small cases (102) against displacement in their transverse direction.

9. Storage and/or transportation case according to claim 8, wherein the large cases (1) comprise a recessed portion (21) in the middle of their lower longitudinal edge, which recessed portion (21) is larger with respect to its dimensioning than the bent portion (16) of the stirrups.

10. Storage and/or transportation case according to claim 9, wherein the longitudinal walls of the small cases (102) are lowered relative to the transverse walls to the height of the handle stirrups which are swiveled inward.

11. A tool for plastics injection molding of a storage and/or transportation case according to claim 1, wherein exchangeable angular insert pieces (22) are provided at a tool half for the production of the undercut guides, which are fixed with respect to the case and serve to fasten the swivel bearings (8), which insert pieces (22) comprise shaped parts (24) only at one of their two legs (23), which shaped parts (24) serve to form the guides at the upper edges of either one of the transverse (4) and longitudinal walls (3) of the case (1, 102).

* * * * *